United States Patent [19]

Gober

[11] Patent Number: 4,709,727

[45] Date of Patent: Dec. 1, 1987

[54] PILOT VALVE

[76] Inventor: Ruel R. Gober, 3525 Lake Catherine, Harvey, La. 70058

[21] Appl. No.: 910,507

[22] Filed: Sep. 23, 1986

[51] Int. Cl.[4] ..... F15B 13/042

[52] U.S. Cl. ..... 137/625.66; 137/269

[58] Field of Search ..... 137/269, 625.66

[56] References Cited

U.S. PATENT DOCUMENTS 3,863,672 2/1975 Theriot et al. ..... 137/596.18

*Primary Examiner*—Gerald A. Michalsky

*Attorney, Agent, or Firm*—Norvell & Associates

[57] ABSTRACT

A pilot valve for effecting a control action selectively in response to the departures of the fluid pressure of a monitored fluid above or below a desired norm. Two axially spaced control fluid inlet ports in the valve body communicate with a valve chamber and a radially disposed fluid outlet port is located intermediate the two fluid inlet ports. Application of fluid to one fluid inlet port will result in the valve responding to an increase in fluid pressure above the desired norm while the application of fluid to the other port will result in the valve responding to a decrease in the monitored fluid pressure from the desired norm. Flow of control fluid from the selected inlet port to the outlet port is controlled by a spring biased spool valve which is axially shiftable within the central valve chamber by a piston responsive to the monitored fluid pressure.

23 Claims, 5 Drawing Figures

PILOT VALVE

BACKGROUND OF THE INVENTION

1. Field of the Invention

The invention relates to a pilot valve for applying or removing a control fluid pressure to a fluid pressure actuator in response to variations of a monitored fluid pressure either above or below a desired normal value.

2. Background of the Invention

Pilot valves for sensing a control fluid pressure and shifting a valve element in response thereto have been widely employed in the prior art. A common form of such valve is the so-called "block and bleed" type which commonly employs a pressure balanced spool valve which is shiftable, responsive to a change in a monitored fluid pressure, to apply or exhaust a control pressure to an actuator which is controllably related to the monitored fluid pressure. The spool valve is normally urged to one position by a spring whose force is opposed by the monitored fluid pressure to be controlled acting on a piston operatively connected to the spool valve to urge the spool valve towards a second position. See, for example, U.S. Pat. No. 4,420,011 to ROGER.

The prior art pilot valves of the "block and bleed" type have uniformly incorporated a pressure balanced spool, i.e., the spool valve is not subject to any pressure forces derived from the control fluid which passes through the valve body in response to a shift in axial position of the spool valve. A balanced spool valve is subject to the practical disadvantage that a wider swing of the control of the monitored fluid pressure must be tolerated due to the friction and inertia forces involved in initiating the movement of the spool valve in response to a change in the monitored fluid pressure from the desired normal value. Thus, when the value of the monitored fluid pressure exceeds the desired norm by an amount sufficient to overcome the friction and inertia forces inherently present in any spool valve, it necessarily follows that the spool valve will not be restored to its original position until the monitored fluid pressure swings in the other direction an equal amount beyond the desired norm. Thus, the sensitivity of the pilot valve is substantially diminished and the accuracy of control of the fluid pressure being monitored is substantially impaired.

SUMMARY OF THE INVENTION

The invention provides a valve body having a central valving chamber within which a spool valve is axially shiftable between a first and a second position. The spool valve is biased to its first position by an adjustable spring and is biased towards its second position by a piston operatively connected to the spool valve and cooperating with a cylinder bore defined in the valve body, the cylinder bore being connected to the monitored fluid pressure.

A pair of axially spaced, radially disposed fluid ports are provided in the valve body to permit the selective supply of control fluid to one of the ports and the utilization of the other port as a vent. When the spool valve is in its first position, it will be closer to one of the radial ports than the other. Conversely, when the spool valve is in its second position, it will be closer to the other of the radial ports than the one port. The spool valve is selectively positioned in either its first or second position depending upon whether actuation of the pilot valve in response to an increase in the monitored pressure above a normal value or a decrease in pressure from the normal value is desired to cause the actuation of the pilot valve. In any case, the radial port farthest from the selected position of the spool valve is connected to a source of control fluid pressure which flows around an exposed seal of the spool valve to enter a control fluid outlet port which is positioned axially intermediate the previously mentioned axially spaced radial ports. The other radial port closest to the selected position of the spool valve will be left open to vent, but seals on the spool valve block communication between the other radial port and the control fluid outlet port. Thus, as long as the piston remains in the aforesaid selected position, control fluid is supplied from the control fluid inlet port to the control fluid outlet port and is supplied to whatever actuator is employed to maintain the pressure level of the monitored fluid pressure. When the monitored fluid pressure departs in the selected direction from the desired norm, the spool valve is shifted from its original selected position to its second position. Such shifting of the spool valve interrupts the flow of control fluid pressure to the control fluid pressure inlet port and concurrently connects the control fluid outlet port to the venting port.

In accordance with this invention, means are provided for concurrently producing a fluid pressure biasing force on the spool valve tending to return the spool valve to its initial selected position. Thus, the monitored fluid pressure would not have to return to a level substantially above or below the desired norm, as the case may be, before the return movement of the spool valve to its initially selected position is initiated.

The means employed for producing such fluid pressure biasing force comprises an annular shuttle which is sealingly disposed intermediate a medial portion of the spool valve and the central chamber of the valve body and is axially shiftable relative to the central chamber. When a control fluid pressure is applied to either one of the axially spaced inlet ports, the shuttle is axially shifted toward the other inlet port and thus automatically conditions the pilot valve to function either in response to a higher than norm monitored fluid pressure or a lower than norm monitored fluid pressure solely through the selection of the inlet port to receive the central fluid pressure.

The shuttle valve is provided with at least one ring of radial ports which are continuously in communication with the control fluid outlet port, regardless of the axial position of the shuttle valve. An external sealing element is provided on the spool valve which cooperates with the bore of the annular shuttle valve and the difference in diameter of this sealing element relative to other external seals provided on the spool valve and exposed to control fluid pressure generates a biasing force urging the spool valve back to its original selected position when the sealing element crosses the ring of ports.

To improve the range of fluid pressure that can be monitored by a spool valve embodying this invention, a plurality of axially spaced cylinder bores of substantially different diameters are provided in the valve body. These bores respectively cooperate with a plurality of piston heads which are operatively connected to the spool valve; however, a sealing element is applied to only a single one of the sealing heads, thus determining the effective piston area which is available for exposure to the monitored fluid pressure. To counteract this wide range of fluid pressure derived forces on the spool valve, the spring urging the spool valve in the opposite direction is provided with an equally wide range of adjustment so that the spring force on the spool valve can be adjusted to be substantially equal to the fluid pressure force exerted on the spool valve by the monitored fluid pressure acting through a selected one of the cylinder heads.

In a preferred modification of this invention, bolt means are provided which are accessible on the exterior of the valve body and traverse the valve body to project into the path of movement of the shuttle valve in both directions. Such bolt means permit axial adjustment of the initial position of the shuttle valve relative to the initial position of the spool valve, thus permitting convenient adjustment of the so-called "dead band" of the pilot valve.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
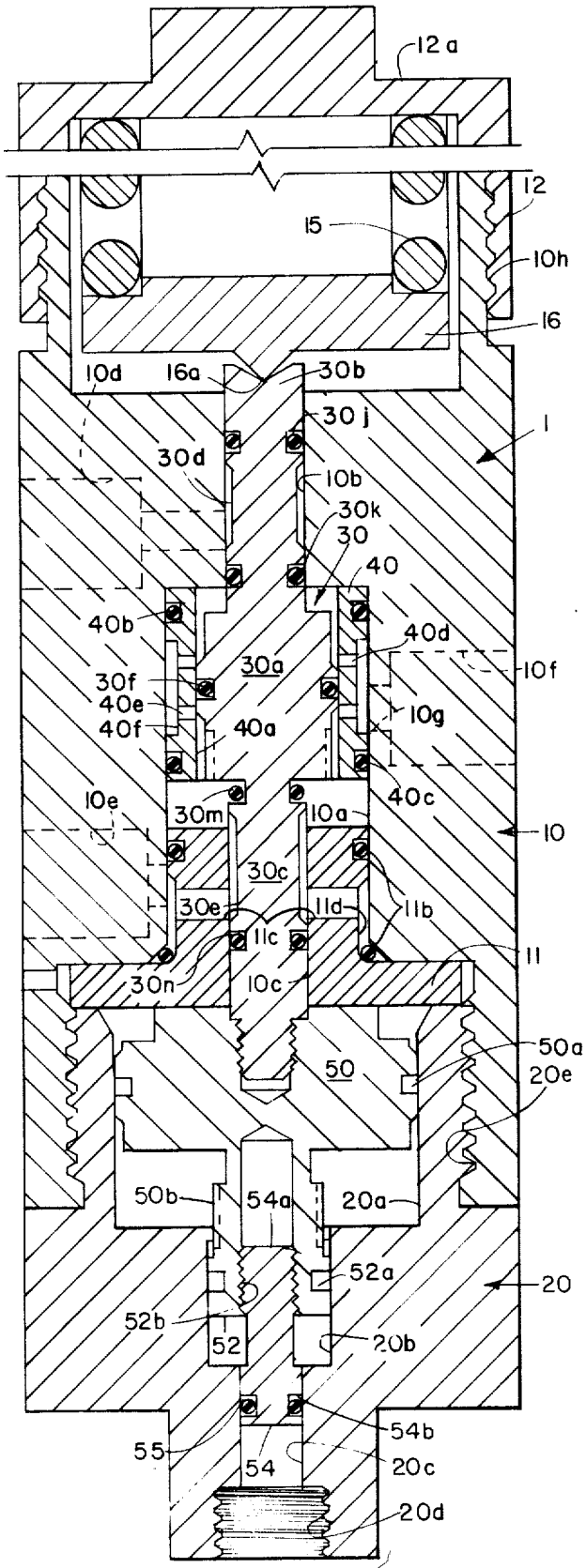
FIG. 1 is a sectional view of a pilot valve embodying this invention showing the spool valve in one of its two selectable axial positions.

A pilot valve 1 embodying this invention comprises a generally tubular valve body 10 defining a central, cylindrical valving chamber 10*a* which is disposed intermediate two axially concentric smaller diameter bores 10*b* and 10*c*. To permit the convenient manufacture and assemblage of the device, the lower bore 10*c* is defined by a separate annular plug element 11 which is held in assemblage in the tubular valve body 10 by a cylinder housing 20 having external threads 20*e* which are threadably engaged with internal threads provided in the end of the valve body 10. O-rings 11*b* seal plug element 11 in tubular body 10.

A pair of radially disposed, selectively utilized, control fluid inlet ports 10*d* and 10*e* are provided in axially spaced relationship in the valve body 10 and respectively communicate with the bores 10*b* and 10*c*. A radially disposed fluid outlet port 10*f* communicates with the central valving chamber 10*a* through a reduced diameter opening 10*g*.

The top end of the valve body 10 is provided with external threads 10*h* which cooperate with threads provided in the bottom end of generally cylindrical spring housing 12 having a closed outer end 12*a*. The threads 10*h* are of considerable axial extent to permit substantial adjustment of the vertical position of the closed end 12*a* of the spring housing 12 relative to the valve body 10.

A valve spool 30 is mounted within the valve body 10 for limited axial movement. Valve spool 30 has an enlarged diameter central portion 30*a* which is mounted in the central chamber 10*a* and two axially projecting cylindrical extensions 30*b* and 30*c* which respectively slidably engage the valve body bores 10*b* and 10*c*. Spool extension 30*b* is provided with an annular recess 30*d* on its periphery which cooperates with the control fluid inlet port 10*d*. Similarly, spool extension 30*c* is provided with an external annular recess 30*e* which cooperates with the other radial control fluid inlet 10*e* through radial ports 11*c* and annular recess 11*d* in plug element 11.

The enlarged central diameter portion 30*a* of the valve spool 30 is of shorter axial extent than the central valve chamber 10*a* and thus permits only limited axial movement of the valve spool 30 with respect to the valve body 10. Additionally, the maximum external diameter of the central spool portion 30*a* is of smaller diameter than the central valve chamber 10*a*, thus providing an annular space for receiving an annular shuttle valve 40. An external seal 30*f* provided on the central spool portion 30*a* cooperates in sealing relationship with the internal bore 40*a* of the shuttle valve 40. The external surface of shuttle valve 40 is sealingly engaged with the central valve chamber bore 10*a* by a pair of axially spaced seals 40*b* and 40*c*.

Figure 2:
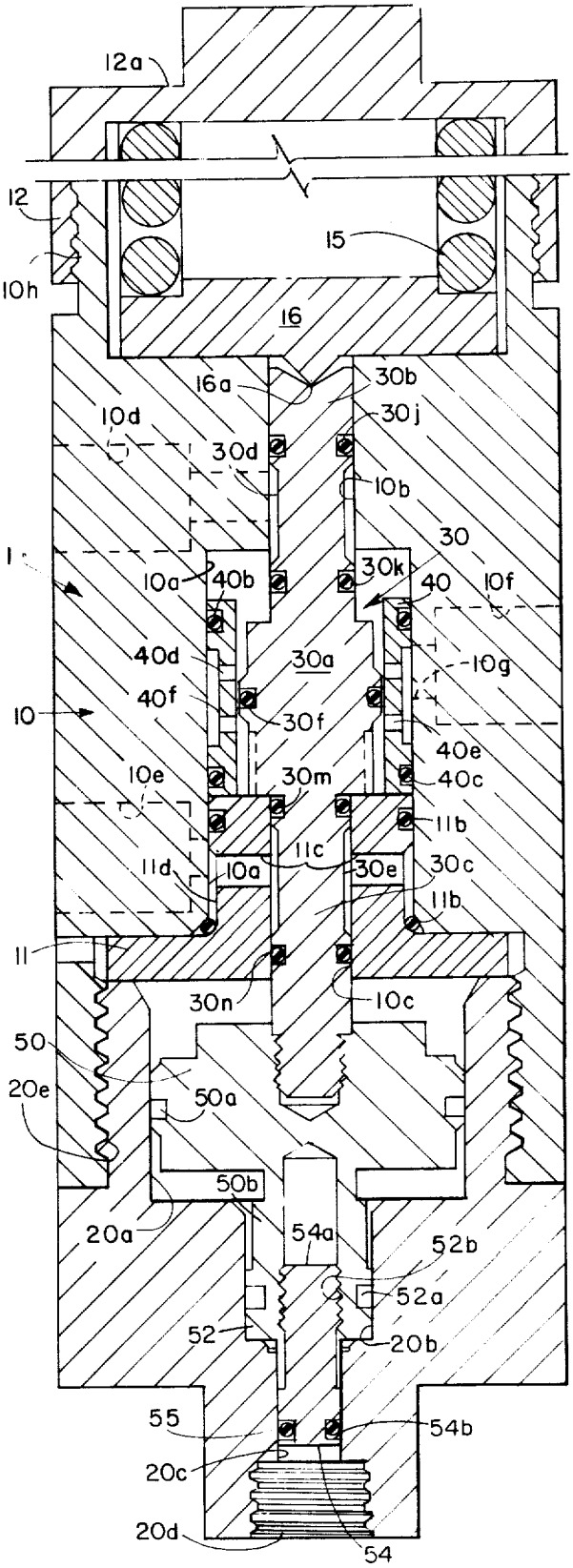
FIG. 2 is a view similar to FIG. 1 but showing the spool valve in the second of its two axially selectable positions.

Each of the cylindrical extensions 30*b* and 30*c* are provided with axially spaced seal rings to selectively effect a sealing engagement with the respective bores 10*b* and 10*c*. Thus, the uppermost extension 30*b*, as shown in FIG. 1, is provided with axially spaced O-rings 30*j* and 30*k*, while the lower shuttle extension 30*c* is provided with axially spaced O-rings 30*m* and 30*n*. Thus, when the shuttle valve 30 is in its uppermost position, as illustrated in FIG. 1, the seals 30*j* and 30*k* are both in sealing engagement with the valve body bore 10*b* and hence the control fluid inlet port 10*d* is effectively sealed off. At the same time, the O-ring 30*m* on the lower axial shuttle valve extension 30*c* is out of engagement with the valve body bore 10*c* or exposed and hence control fluid, either pneumatic or hydraulic, may freely flow through the lower control inlet port 10*e* upwardly and around the valve spool extension 30*c* and into the central valving chamber 10*a*. Conversely, when the spool valve 30 is in its lowermost position in the valve body 10, as illustrated in FIG. 2, the lower control fluid inlet port 10*e* is effectively sealed off by the engagement of O-rings 30*m* and 30*n* with the valve body bore 10*c*. At the same time, the O-ring 30*k* on the upper shuttle valve extension 30*c* is moved out of engagement with the valve body bore 10*b* and the uppermost control fluid inlet port 10*d* is placed in direct fluid communication with the central valve chamber 10*a*.

Valve spool 30 is biased downwardly, as viewed in the drawings, by a compression spring 15 which is mounted between the closed end 12*a* of the spring housing 12 and a circular compression plate 16 which is abuttingly engaged through a depending projection 16*a* with the top end of the valve spool extension 30*b*.

To offset the downward spring bias on the valve spool, the lower valve spool extension 30*c* is connected to a plurality of axially concentric pistons 50, 52 and 54. Piston 50 has the largest diameter and is mounted within a large counterbore 20*a* provided in the cylinder housing 20. An O-ring groove 50*a* is provided on the periphery of the major piston 50 to selectively receive an O-ring if the major piston is selected to apply a force in opposition to the spring bias. Major piston 50 has a reduced diameter axial extension 50b which defines the intermediate diameter piston 52. Piston 52 also has an external O-ring groove 52a for selectively receiving an O-ring in sealing engagement with an intermediate diameter counterbore 20b formed in the cylinder housing 20.

Intermediate piston 52 defines internal threads 52b which cooperate with external threads provided on an axial extension 54a of the third or smallest diameter piston 54. Piston 54 defines an external O-ring groove 54b within which an O-ring may be selectively mounted to sealingly cooperate with the smallest diameter portion 20c of the bore provided in the cylinder housing 20.

The lower end of cylinder housing 20 defines internal threads 20d which cooperate with a suitable fitment leading to a source of pressured fluid for which monitoring of the fluid pressure is required. The pressured fluid may be pneumatic or hydraulic. Such connections are conventional and require no further description nor illustration.

An O-ring seal 55 is inserted in a selected one of the grooves 54a, 52a and 50a, depending on the normal value of the fluid pressure to be monitored. If the fluid pressure to be monitored is relatively high, then the O-ring 55 is applied to the smallest diameter piston 54, as illustrated in FIG. 1. Smaller values of a normal fluid pressure to be monitored require an O-ring to be inserted in either of the two larger diameter pistons 52 and 50.

The pilot valve 1 embodying this invention has the characteristics of being selectively actuated either in response to an increase in fluid pressure of the monitored fluid pressure above a desired norm or to a decrease in such fluid pressure below a desired norm. To establish the valve to respond to an increase in fluid pressure above the desired norm, a control fluid pressure is applied to the lowermost port 10e which shifts shuttle valve 40 to its uppermost position in central chamber 10a.

The spring 15 is adjusted so that at the normal monitored fluid pressure, the spool valve 30 is in its uppermost position as illustrated in FIG. 1. In this selected arrangement, the second control fluid port 10d is vented to atmosphere. If it is desired that the pilot valve 1 respond to a decrease in fluid pressure below the normal monitored fluid pressure, then the control fluid pressure would be applied to the uppermost control fluid inlet port 10d and the lowermost inlet port 10e would be vented to atmosphere. Additionally, the spring 15 would be adjusted to shift the valve plunger 30 to its lowermost position relative to the central valve chamber 10a, as illustrated in FIG. 2.

One last feature of construction of the pilot valve 1 should be mentioned. The shuttle valve 40 is provided with two rings of axially spaced ports 40d and 40e which are separated a sufficient distance to permit the external O-ring seal 30f provided on the enlarged central body portion 30a of the spool valve 30 to sealingly engage the bore surface intermediate the two rings of ports 40d and 40e. Ports 40d and 40e communicate with an annular external recess 40f which is always in communication with control fluid outlet ports 10g and 10f.

With this arrangement, it will be readily apparent to those skilled in the art that when the control fluid pressure is being supplied through the lowermost control fluid inlet port 10e, and the spool valve 30 is in its uppermost position, the shuttle valve 40 will likewise be biased to its uppermost position as shown in FIG. 1. On the other hand, when the control fluid pressure is being supplied through the upper control fluid inlet port 10d, and the spool valve 30 is in its lowermost position (FIG. 2), the shuttle valve 40 will likewise be fluid pressure biased to its lowermost position relative to the central valving chamber 10a of the valve body 1.

The operation of the aforedescribed pilot valve 1 will be readily apparent to those skilled in the art from the foregoing description. Assuming that the lower control fluid port 10e is connected to a source of control fluid, the upper control fluid port 10d is vented to atmosphere, and the spring 15 adjusted to position the spool valve 30 in the position illustrated in FIG. 1. No net biasing force is applied to the spool valve because the control fluid is in contact with both the upper and lower end faces of central portion 30a by virtue of the bypass of seal ring 30f by shuttle valve ports 40d and 40e. The spool valve 30 will remain substantially in that position until the pressure of the fluid being monitored decreased from the desired normal value, whereupon the biasing force of spring 15 will move the spool valve 30 downwardly. Such downward movement effects the cutoff of control fluid pressure from the selected supply port 10e and concurrently connects the outlet fluid port with the port 10d to vent whatever control fluid pressure exists therein. Thus, the necessary control action has been effected by cutting off control fluid pressure exiting from the outlet port 10f, and the system in which the pilot valve 1 is connected will respond in conventional fashion to bring the fluid pressure being monitored upwardly to its normal value, whereupon the pilot valve will return to the position illustrated in FIG. 1. It should be noted, however, that as soon as the O-ring 30f on the enlarged central portion 30a of the spool valve 30 passes below the lowermost ring 40e of ports in the shuttle valve 40, the spool valve 30 is then subjected to a fluid pressure in an upward direction, tending to restore the spool valve to its initial position by the action of the control fluid pressure supplied to the chamber 10a below the shuttle valve 40. No control fluid pressure exists above the seal ring 30f on spool valve 30, as that region is vented by seal 30k moving out of the bore 10b. This supplemental biasing force on the pilot valve 30 tends to counteract the delaying effects of friction in the mechanism which would normally require the fluid pressure being monitored to rise to a value significantly above the desired norm before return movement of the pilot valve 30 would be initiated, hence permits the spool valve 30 to return more rapidly to its normal position and thus increases the efficiency of the control valving action.

The operation of the pilot valve 1 in response to an increase in fluid pressure being monitored above a desired normal value is accomplished by positioning the valve elements in the manner illustrated in FIG. 2. In this Figure, the control fluid pressure is now applied to the uppermost control fluid inlet port 10d and the lower control fluid inlet port 10e is vented to atmosphere. The spool valve 30 is shifted by adjustment of the compression spring 15 to a position in the lower portion of the central valve chamber 10a, thus opening communication between the control fluid inlet port 10d and the control fluid outlet port 10f, while sealing off the control fluid inlet port 10e which is vented to atmosphere. Under these conditions, the shuttle valve 40 will concurrently be shifted downwardly to the position shown in FIG. 2. Upon an increase in pressure of the fluid pressure being monitored above the desired normal value, the pilot valve 30 will be shifted upwardly by the effect of such increased fluid pressure on the selected piston 50, 52, or 54, as the case may be. This action produces a shifting of the O-ring 30*f* on the enlarged central portion 30*a* of the shuttle valve 30 to a position above the uppermost ring of ports 40*d* provided on the shuttle valve 40 In such uppermost position of the spool valve 30, the supply of control fluid pressure from the inlet port 10*d* is cut off and the control fluid outlet port 10*f* is placed in fluid communication with the inlet port 10*e* which is vented to atmosphere. At the same time, the spool valve 30 is subjected to a downward force by the control fluid pressure supplied to the central valve chamber 10*a* above the shuttle valve 40 thus rendering the spool valve 30 more susceptible to return to its normal position upon a decrease in pressure of the fluid pressure being monitored.

While the operation of the pilot valve 1 embodying this invention has been described only in connection with the interruption of flow of a control fluid to a conventional mechanism for controlling the pressure of the fluid being monitored, such valve may be equally applied to the initiation of supply of control fluid to any such mechanism. Thus, the versatility of the pilot valve embodying this invention renders it fully competitive with any prior art pilot valves.

Referring now to FIGS. 2A and 2B, there is shown a modification of this invention wherein adjustment means are provided for adjusting the initial position of the shuttle valve 40 with respect to the spool valve 30 thereby effecting an adjustment of the so-called "dead band" of the pilot valve. By "dead band" is meant the amount of movement of the spool valve 30 that is required to effect a cutoff of fluid flow from the selected one of the control fluid inlet ports to the control fluid outlet port. As will be apparent from observing the drawings, such cutoff first occurs whenever the O-ring seal 30*f* mounted on the enlarged diameter portion 30*a* of spool valve 30 moves downwardly past the lower ring of ports 30*e* in the shuttle 40 or upwardly past the upper ring of ports 40*d* in the shuttle 40 depending upon whether the pilot valve is connected to be responsive to a decrease or increase in fluid pressure of the monitored fluid relative to the desired normal value.

Figure 3:
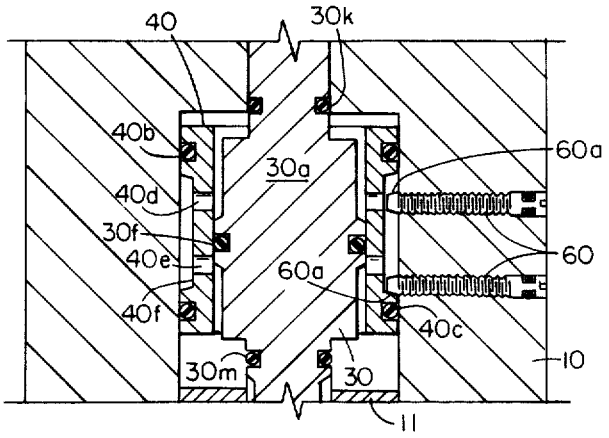
FIG. 3 is a partial sectional view of the central portion of the pilot valve showing the bolt means for adjusting one initial position of the shuttle valve.
Figure 4:
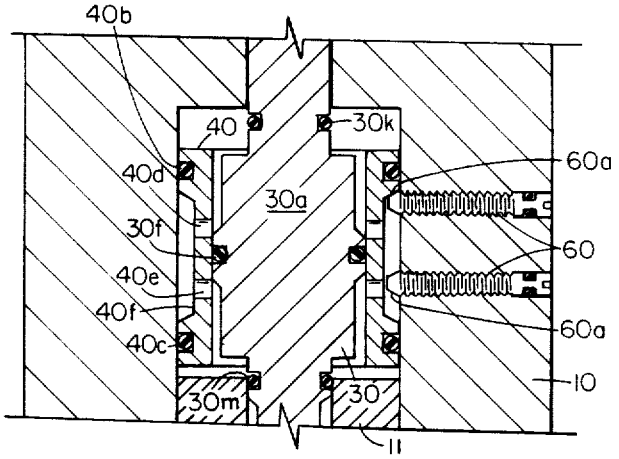
FIG. 4 is a view similar to FIG. 3 but illustrating the cooperation of the bolt means with shuttle valve in the other initial position of the shuttle valve.

Such adjustment of the "dead band" may be conveniently accomplished externally of the pilot valve through the provision of a plurality of shuttle position adjusting screws 60. Screws 60 are threadably radially inserted through the valve body 10 and cooperate with the end walls of the annular fluid flow recess 40*f* provided on the outer periphery of the shuttle valve 40 intermediate the seal rings 40*b* and 40*c*. The upper ends of recess 40*f* are inclined and the inner ends 60*a* of the adjustment screws 60 are correspondingly tapered so that radial advancement of the lower adjustment screw, as illustrated in FIG. 3, will effect a downward shifting of the shuttle valve 40 relative to the spool valve 30, while, as shown in FIG. 4, an inward adjustment of the upper adjustment screw 60 will effect an upward displacement of the shuttle valve 40 relative to the spool valve 30. The "dead band" of the apparatus may thus be conveniently adjusted externally of the pilot valve 1 to provide a range of "dead bands" for such valve, hence increasing or decreasing the sensitivity of the pilot valve 1 to changes in fluid pressure of the fluid being monitored, as desired by the operator of the system.

Figure 5:
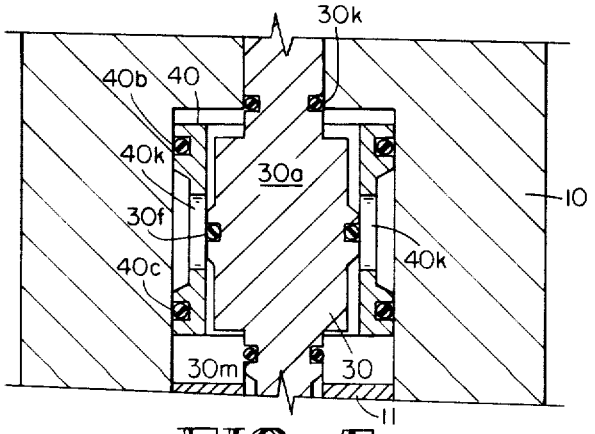
FIG. 5 is a partial sectional view of the pilot valve showing a modified construction of the shuttle valve ports.

Referring now to FIG. 5, a modification of this invention is shown wherein similar numerals represent parts similar to those already described. The only change in the construction is the utilization of large holes or elongated slots 40*k* in the walls of the shuttle valve 40 in place of the two rings of ports 40*d* and 40*e*. The axial length of the holes or slots 40*k* should substantially exceed the axial extent of the O-ring 30*f* provided on the enlarged diameter portion 30*a* of the spool valve 30. Thus, in the normal position of spool valve 30, corresponding to the monitored fluid pressure being at a normal value, the O-ring 30*f* is disposed centrally relative to the slots or holes 30*k* and no biasing is exerted by the control pressure on the spool valve 30, since the control fluid flows through the ends of the elongated holes or slots 40*k* to bypass the O-ring seal 30*f*. The operation of the modification illustrated in FIG. 5 is identical to that previously described.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A pilot valve selectively actuable by either a higher than normal monitored fluid pressure or a lower than normal monitored fluid pressure comprising a valve body having a central cylindrical chamber and first and second reduced diameter bores respectively coaxially communicating with opposite axial ends of said central cylindrical chamber; a spool valve having a radially enlarged central portion disposed in said central cylindrical valve chamber and axially concentric cylindrical end ports respectively slidably mounted in said first and second bores; the axial extent of said central portion being less than the axial extent of said central valve chamber, thereby permitting limited axial movement of said spool valve from a first position relative to said valve body to a second position; a pair of generally radial fluid supply ports in said valve body respectively communicating with said first and second bores; one of said fluid supply ports being connectable to a source of pressure fluid when said other port is vented; the other of said ports being connectable to a source of fluid pressure when said one port is vented; means for applying a spring bias to one of said spool valve end ports to urge said spool valve in one axial direction; piston means exposable to the monitored fluid pressure operatively connected to the other of said spool valve end ports to impose a biasing force on said spool valve in opposition to said spring bias, whereby the axial position of said spool valve in said valve body is determined by the differential between said spring biasing force and said monitored biasing force; means for adjusting said spring force to selectively initially position said spool valve in either said first position or said second position in said central valve chamber; sealing means permitting passage of fluid from one of said radial supply ports to said central cylindrical chamber when said valve spool is in said first position and from the other of said radial supply ports to said central cylindrical chamber when said valve spool is in said second position; an annular shuttle valve slidably mounted intermediate said central portion of said valve spool and the wall of said central chamber for limited axial movements relative thereto; said annular shuttle valve having at least one ring of radial ports through the wall of the medial portion thereof; said valve body having a radial control fluid outlet port communicable with said radial ports in said shuttle valve in all positions of said shuttle valve; sealing means between each axial end of said shuttle valve and the wall of said cylindrical inner chamber; and a single external seal between the medial portion of said radially enlarged central portion of said spool valve and the inner wall of said annular shuttle valve, whereby the connection of either fluid supply port to a source of fluid pressure will axially shift said shuttle valve away from the fluid supply port supplying fluid pressure and will supply a biasing force to said spool valve only when displaced from said selected initial position to aid in returning said spool valve to said selected initial position.

2. The pilot valve of claim 1 wherein said annular shuttle valve has two axially spaced rings of radial ports and said single external seal on said spool valve being located axially intermediate said axially spaced radial ports in either of said selected initial positions of said spool valve.

3. The pilot valve of claim 1 wherein said annular shuttle valve has a ring of ports of greater axial extent than said single external seal on said spool valve; said single external seal being located in traversing relation to said ring of ports in either of said selected initial positions of said spool valve.

4. The pilot valve of claim 1 further comprising means for axially adjusting the initial position of said shuttle valve relative to said initial position of said spool valve.

5. The pilot valve of claim 4 further comprising bolt means traversing said valve body and disposed in the paths of axial movement of said shuttle valve in both directions; said bolt means being engagable with said shuttle valve to adjust the initial position of said shuttle valve relative to said initial position of said spool valve, thereby adjusting the dead band of the pilot valve.

6. A pilot valve in accordance with claim 1 wherein said piston means comprises a plurality of axially spaced cylinder bores of different diameters concentrically disposed in said tubular valve body, a plurality of piston heads operatively connected to said spool valve and respectively slidably mounted in said cylinder bores, and seal ring encompassing only a selected one of said piston heads, thereby permitting selection of the piston area responsive to the monitored fluid pressure.

7. A pilot valve selectively actuable by either a higher than normal monitored fluid pressure or a lower than normal monitored fluid pressure comprising: a valve body having a central cylindrical chamber and first and second reduced diameter bores respectively coaxially communicating with opposite axial ends of said central cylindrical chamber; a spool valve having a radially enlarged central portion disposed in said central cylindrical valve chamber and axially concentric cylindrical end portions respectively slidably mounted in said first and second bores; the axial extent of said central portion being less than the axial extent of said central valve chamber, thereby permitting limited axial movement of said spool valve from a first position relative to said valve body to a second position; each of said end portions of said spool valve defining an axial fluid passage along a portion of its external surface; a pair of external seals on each said end portion straddling said axial fluid passage and sealably engagable with said respective bore; the outermost external seals being sealingly engaged with the respective bore in both axial positions of said spool valve, the innermost seals being selectively engaged with the respective bore depending on the axial position of said spool valve relative to said central chamber; a pair of generally radial control fluid supply ports in said valve body respectively communicating with said first and second bores intermediate said external seals; one of said fluid supply ports being connectable to a source of pressure fluid when said other port is vented; the other of said ports being connectable to a source of fluid pressure when said one port is vented; means for applying a spring bias to one of said spool valve end portions to urge said spool valve in one axial direction; piston means exposable to the monitored fluid pressure operatively connected to the other of said spool valve end portions to impose a biasing force on said spool valve in opposition to said spring bias, whereby the axial position of said spool valve in said valve body is determined solely by the differential between said spring biasing force and said monitored biasing force; means for adjusting said spring force to selectively initially position said spool valve in either said first position or said second position in said central valve chamber; whereby said spool valve is shiftable from said first position by an increase in monitored fluid pressure and from said second position by a decrease in monitored fluid pressure; an annular shuttle valve slidably mounted intermediate said central portion of said spool valve and the wall of said central chamber for limited axial movements relative thereto; said annular shuttle valve having at least one ring of radial ports through the wall of the medial portion thereof; said valve body having a radial control fluid outlet port communicable with said radial ports in said shuttle valve in all positions of said suttle valve; sealing means between each axial end of said shuttle valve and the wall of said cylindrical inner chamber; and a single external seal between the medial portion of said radially enlarged central portion of said spool valve and the inner wall of said annular shuttle valve, whereby the connection of either fluid supply port to a source of fluid pressure will axially shift said shuttle away from the fluid supply port supplying fluid pressure and will supply a biasing force to said spool valve only when displaced from said selected initial position to aid in returning said spool valve to said selected initial position.

8. The pilot valve of claim 7 wherein said annular shuttle valve has two axially spaced rings of radial ports communicating with said control fluid outlet port and said single external seal on said spool valve being located axially intermediate said axially spaced radial ports in either of said selected initial positions of said spool valve.

9. The pilot valve of claim 7 wherein said annular shuttle valve has a ring of ports of greater axial extent than said single external seal on said spool valve; said single external seal being located in traversing relation to said ring of ports in either of said selected initial positions of said spool valve.

10. The pilot valve of claim 7 further comprising means for axially adjusting the initial position of said shuttle valve relative to said initial position of said spool valve.

11. The pilot valve of claim 10 further comprising bolt means traversing said valve body and disposed in the paths of axial movement of said shuttle valve in both directions; said bolt means being engagable with said shuttle valve to adjust the initial position of said shuttle valve relative to said initial position of said spool valve, thereby adjusting the dead band of the pilot valve.

12. A pilot valve in accordance with claim 7 wherein said piston means comprises a plurality of axially spaced cylinder bores of different diameters concentrically disposed in said tubular valve body, a plurality of piston heads operatively connected to said spool valve and respectively slidably mounted in said cylinder bores, and a seal ring encompassing only a selected one of said piston heads, thereby permitting selection of the piston area responsive to the monitored fluid pressure.

13. A pilot valve comprising a tubular valve body having a central bore; a radially disposed control fluid inlet port communicating with said central bore; a radially disposed venting port communicating with said central bore at a location axially spaced from said control fluid inlet port; a radially disposed control fluid outlet port communicating with said central bore intermediate said control fluid inlet and outlet ports; a spool valve mounted in said central bore for limited axial movements between a first position and a second position; sealing means between said central bore and said spool valve for directing control fluid from said control fluid inlet port to said control fluid outlet port and preventing fluid communication with said venting port when said spool valve is in said first position, and connecting said venting port and said control fluid outlet port and preventing fluid communication with said control fluid inlet port when said spool valve shifts to said second position; resilient means urging said spool valve to said first position; piston means responsive to a monitored fluid pressure urging said spool valve to said second position; and means responsive to control fluid pressure in said central bore for biasing said spool valve toward said first position only when displaced therefrom to said second position.

14. A pilot valve in accordance with claim 13 wherein said means responsive to control fluid pressure comprises an annular shuttle valve sealingly mounted intermediate said spool valve and said central bore; said annular shuttle valve having at least one ring of ports continuously in communication with said control fluid outlet port.

15. A pilot valve in accordance with claim 14 further comprising an external sealing ring on said spool valve having an axial extent less than said one ring of ports in said shuttle; said external sealing ring being located in traversing relation to said one ring of ports in said first position of said spool valve.

16. A pilot valve in accordance with claim 15 further comprising means for adjusting said resilient means to selectively position said spool valve in either of said first or second positions when a normal value of said monitored fluid pressure exists.

17. The pilot valve of claim 14 further comprising means for axially adjusting the initial position of said shuttle valve relative to said initial position of said spool valve.

18. The pilot valve of claim 14 further comprising bolt means traversing said valve body and disposed in the paths of axial movement of said shuttle valve in both directions; said bolt means being engagable with said shuttle valve to adjust the initial position of said shuttle valve relative to said initial position of said spool valve, thereby adjusting the dead band of the pilot valve.

19. A pilot valve in accordance with claim 13 wherein said means responsive to control fluid pressure comprises an annular shuttle valve sealingly mounted intermediate said spool valve and said central bore; said annular shuttle valve having a pair of axially spaced rings of radial ports continuously in communication with said control fluid outlet port; and an external O-ring mounted on said spool valve and sealingly engagable with the bore of said annular valve shuttle intermediate said axially spaced ports when said spool valve is in said first position.

20. A pilot valve in accordance with claim 19 further comprising means for adjusting said resilient means to selectively position said spool valve in either of said first or second positions when a normal value of said monitored fluid pressure exists.

21. A pilot valve in accordance with claim 19 wherein said piston means comprises a plurality of axially spaced cylinder bores of different diameters concentrically disposed in said tubular valve body, a plurality of piston heads operatively connected to said spool valve and respectively slidably mounted in said cylinder bores, and a seal ring encompassing only a selected one of said piston heads, thereby permitting selection of the piston area responsive to the monitored fluid pressure.

22. A pilot valve in accordance with claim 13 further comprising means for adjusting said resilient means to selectively position said spool valve in either of said first or second positions when a normal value of said monitored fluid pressure exists.

23. A pilot valve in accordance with claim 13 wherein said piston means comprises a plurality of axially spaced cylinder bores of different diameters concentrically disposed in said tubular valve body, a plurality of piston heads operatively connected to said spool valve and respectively slidably mounted in said cylinder bores, and a seal ring encompassing only a selected one of said piston heads, thereby permitting selection of the piston area responsive to the monitored fluid pressure.

* * * * *

UNITED STATES PATENT AND TRADEMARK OFFICE

CERTIFICATE OF CORRECTION

PATENT NO. : 4,709,727

DATED : December 1, 1987

INVENTOR(S) : Ruel R. Gober and Kip B. Goans

It is certified that error appears in the above-identified patent and that said Letters Patent is hereby corrected as shown below:

Cover page, Item (19), "Gober" should read -- Gober et al --.

Cover page, line [76] after the address for Ruel R. Gober, add "; Kip B. Goans, 2576 Apollo Ave., Harvey, LA 70053".

Signed and Sealed this

Seventh Day of June, 1988

*Attest:*

*Attesting Officer*

DONALD J. QUIGG

*Commissioner of Patents and Trademarks*